US007506959B2

(12) United States Patent
Ueda et al.

(10) Patent No.: US 7,506,959 B2
(45) Date of Patent: Mar. 24, 2009

(54) INKJET PRINTER AND BUBBLE REMOVING METHOD IN INKJET PRINTER

(75) Inventors: Masato Ueda, Tokyo (JP); Katsuaki Komatsu, Tokyo (JP)

(73) Assignee: Konica Minolta Holdings, Inc., Tokyo (JP)

( * ) Notice: Subject to any disclaimer, the term of this patent is extended or adjusted under 35 U.S.C. 154(b) by 374 days.

(21) Appl. No.: 11/422,471

(22) Filed: Jun. 6, 2006

(65) Prior Publication Data

US 2006/0279604 A1 Dec. 14, 2006

(30) Foreign Application Priority Data

Jun. 9, 2005 (JP) ..... 2005-169731

(51) Int. Cl.
*B41J 2/165* (2006.01)

(52) U.S. Cl. ..... 347/29

(58) Field of Classification Search ..... 347/22, 347/23, 24, 29, 30, 32, 92
See application file for complete search history.

(56) References Cited

U.S. PATENT DOCUMENTS 5,828,395 A * 10/1998 Takata ..... 347/86
6,183,078 B1 * 2/2001 Pietrzyk et al. ..... 347/92
6,517,189 B2 * 2/2003 Ogawa et al. ..... 347/35

* cited by examiner

*Primary Examiner*—Shih-Wen Hsieh
(74) *Attorney, Agent, or Firm*—Lucas & Mercanti, LLP

(57) ABSTRACT

Disclosed is an inkjet printer including: a recording head having nozzles for ejecting ink; an ink tank for reserving the ink; an ink-flow passage for supplying the ink from the ink tank to the recording head; a valve for opening or closing the ink-flow passage; a filter disposed in the ink-flow passage between the valve and the recording head; a vacuum cap to be coupled to the recording head so as to cover an ejection opening of the nozzle when sucking an ink from the ejection opening; and a vacuum pump for sucking the ink from the ejection opening through the vacuum cap, wherein the printer includes a bubble-storing portion provided at least at a part of the ink-flow passage between the filter and the recording head, for storing a predetermined volume of bubble.

7 Claims, 7 Drawing Sheets

INKJET PRINTER AND BUBBLE REMOVING METHOD IN INKJET PRINTER

BACKGROUND OF THE INVENTION

1. Field of the Invention

The present invention relates to an inkjet printer and a bubble removing method in an inkjet printer, and more particularly, to an inkjet printer and a bubble removing method in an inkjet printer having a structure for removing bubbles in an ink-flow passage.

2. Description of Related Art

An inkjet printer that ejects ink on a recording medium, such as a paper and a plastic sheet, to record a given image thereon, has been proposed and put into practice. Such an inkjet printer has a recording head for ejecting ink supplied from an ink tank through an ink-flow passage. In a serial-type inkjet printer, for example, while a recording head mounted on a carriage moves in a predetermined direction, ink is ejected from the recording head toward a recording medium to record a given image on the recording medium. In a line-type inkjet printer, ink is ejected from a line-type recording head onto a recording medium transported in a predetermined transporting direction to record a given image on the recording medium.

In the aforementioned inkjet printer, as shown in FIG. 8, a filter 92 for removing contamination in ink is often disposed in an ink-flow passage 90 which is provided between an ink tank (not shown) and a pressure chamber 84 in a recording head 80. In this inkjet printer, a bubble K2 gets into the ink-flow passage 90 sometimes. The bubble K2 got into the ink-flow passage 90 provided between the ink tank and the filter 92 is easily trapped by the filter 92, to stay at the upstream side of the filter 92. The bubble K2 staying at the upstream side of the filter 92 clogs up the filter to form flow-passage resistance which causes ejection failures such as non-ejection, reduction of droplet volume or the like.

In detail, when a bubble stays at the upstream of a filter, the bubble forms meniscuses on filter meshes, which makes the area for the ink to pass through the filter smaller, to lower a pressure due to the ink flowing into the recording head from the ink-flow passage, resulting in the rise of backpressure to the recording head. When the backpressure to the recording head rises over a predetermined value, a meniscus formed at an ejection opening of a nozzle in the recording head breaks and a bubble gets into the pressure chamber of the recording head from the ejection opening. The bubble causes reduction of the pressure in the pressure chamber necessary for ejecting ink and may thereby cause ejection failures in the recording head, e.g., non-ejection, decrease of droplet volume or the like.

Conventionally, it has been said that a bubble retained at the upstream of the filter passes through the filter and stay in the pressure chamber of the head, and the bubble reduces the pressure in the pressure chamber necessary for ejecting ink. However, since the bubble passed through the filter is very small, it is thought that the bubble is dissolved in the ink before it reaches the pressure chamber. Therefore, in many cases, it is thought that reduction of the pressure in the pressure chamber which is necessary for ejecting ink, is actually caused by the bubble got in the pressure chamber through the ejection opening because of meniscus break due to the rise of backpressure. It is very important to solve this problem.

In order to remove the bubbles K2 retained at the upstream of the filter 92, a method in which a suction device sucks the bubble K2 together with ink from the ejection opening (orifice) 83 of a nozzle 82 to suck out the bubble K2 through the orifice, has been employed. In the method, a high pressure is needed for the bubble K2 to pass through the filter 92. In order to generate such a high pressure, a method for removing the bubble K2, including the steps of, providing a valve 95 at the upstream of the filter 92 in the ink-flow passage 90, performing suction by the suction device through the orifice 83 of the nozzle 82 with the valve 95 closed, and thereafter opening the valve 95 to accelerate ink-flow speed, is proposed (see, for example, JP-2000-289225A).

However, even if suction is performed by the suction device through the nozzle orifice with the valve closed and thereafter the valve is opened, as described above, the bubbles actually cannot be removed because the ink-flow speed does not increase, unless a differential pressure between the upstream and the downstream of the filter reaches a value to cause meniscus break so that the ink at the upstream of the filter flows into the downstream side through the filter.

In case that the ink-flow passage at the downstream of the filter, that is, the ink-flow passage between the filter and the recording head is filled with ink without a bubble, the volume of liquid ink hardly changes to a pressure even by sucking with the valve closed.

At the upstream of the filter, on the contrary, the bubble expands due to negative pressure when sucked with the valve closed. However, because the volume of liquid ink hardly changes at the filter downstream, the expanded bubble just shrinks to return to the original volume when the valve is opened, and therefore the meniscus does not break and the bubble does not flow into the downstream side through the filter.

Accordingly, the bubble remains in the ink-flow passage at the filter upstream for a long time. As a result, it sometimes causes lasting malfunction such as ejection failures in the head.

In a conventional inkjet printer, a recording head has not so many nozzles in most cases and a flow passage has a small flow resistance due to a small cross-section in most cases, therefore removal of bubble can be achieved relatively easily by suction without particular consciousness about the above-described problem. However, recently, a large-scale recording head with many nozzles has been manufactured for speed up of image recording and use of a line-type head. The larger recording head causes the flow-passage cross-section to be larger, and therefore a filter area is necessitated to be relatively larger to reduce the flow-passage resistance. Resultantly, bubbles tend to remain at the filter upstream. Therefore, when removing bubbles using a valve in a large-sized recording head, it is necessary not to simply raise the flowing speed but to consciously generate large differential pressure between the upstream and the downstream of the filter so as to break the meniscus.

SUMMARY OF THE INVENTION

In order to solve the above-described problems, an object of the invention is to provide an inkjet printer and a bubble removing method in an inkjet printer, the printer having a structure for securely removing bubbles occurred at an upstream of a filter in an ink-flow passage to securely solve ejection failures in a recording head, such as non-ejection and decrease of droplet volume.

In order to achieve the object, according to a first aspect of the invention, the inkjet printer comprising: a recording head having nozzles for ejecting ink; an ink tank for reserving the ink; an ink-flow passage for supplying the ink from the ink tank to the recording head; a valve for opening or closing the ink-flow passage; a filter disposed in the ink-flow passage between the valve and the recording head; a vacuum cap to be coupled to the recording head so as to cover an ejection opening of the nozzle when sucking an ink from the ejection opening; and a vacuum pump for sucking the ink from the ejection opening through the vacuum cap, wherein the printer includes a bubble-storing portion provided at least at a part of the ink-flow passage between the filter and the recording head, for storing a predetermined volume of bubble.

As described above, this inkjet printer includes a bubble-storing portion provided at least at a part of the ink-flow passage between the filter and the recording head, for storing a predetermined volume of bubble, that is, in a part of the ink-flow passage at the downstream of the filter. Therefore, when the bubble which is gas retained in the bubble-storing portion, is sucked from the ejection opening of the nozzle in the recording head with the valve closed, the bubble expands by a regative pressure. Thereafter, by opening the valve, the expanded bubble goes shrinking to return to the original. At this time, volume change occurs depending on the amount of the retained bubble. When a substantial pressure is applied to the filter by the volume change and the like, a large differential pressure is caused between the upstream and the downstream of the filter. This differential pressure forcibly moves the ink and bubble from the upstream toward the downstream of the filter upon releasing the valve. The abrupt moving force by the ink and bubbles breaks the meniscus formed on the filter, and the ink at the filter upstream flows into the downstream by passing through the filter. At this time, the bubble at the filter upstream simultaneously flows into the downstream side by passing through the filter. A part of the bubble flowed into the downstream is dissolved into the ink while flowing in the ink, and another part of the bubble is united with the bubble retained in the bubble-storing portion, and the other part is sucked from the ejection opening of the nozzle. Thus, the bubble occurred at the upstream of the filter in the ink-flow passage can be removed.

Because the bubble occurred at the upstream of the filter in the ink-flow passage can be removed, it is possible to securely solve the problem of ejection failures in the recording head, such as non-ejection, decrease of droplet volume or the like, and to form excellent images.

Preferably, the inkjet printer further comprises a bubble-injecting device for sending a bubble into the bubble-storing portion.

Since the inkjet printer is provided with the bubble-injecting device for sending the bubble into the bubble-storing portion, even if the bubble retained in the bubble-storing portion is ejected from the ejection opening of the nozzle, repeated injection of the bubble can easily resume the state in which the bubbles retained at the filter upstream in the ink-flow passage can be removed.

Preferably, the bubble-injecting device has a structure to inject the bubble into the ink-flow passage provided between the filter and the recording head, to send the bubble into the bubble-storing portion.

storing portion.

Preferably, the bubble-injecting device has a structure to inject the bubble from the ejection opening of the nozzle in the recording head, to send the bubble into the bubble-storing portion.

Preferably, the bubble-injecting device has a structure to inject the bubble into the upstream of the filter so as to cover the entire filter and to transmit the bubble through the filter to the downstream thereof to send the bubble into the bubble-storing portion.

Thus, this inkjet printer defines patterns of specific structure for sending the bubble into the bubble-storing portion.

Accordingly, even if the bubble retained in the bubble-storing portion is ejected from the ejection opening of the nozzle, it is possible to easily return to the state in which the bubbles retained at the filter upstream in the ink-flow passage can be removed, by injecting the bubble again. Therefore, it is possible to solve the problem of ejection failures in the recording head, such as non-ejection, decrease of droplet volume or the like, more securely, and to form excellent images.

According to a second aspect of the invention, the inkjet printer comprises: a recording head having nozzles for ejecting ink; an ink tank for reserving the ink; an ink-flow passage for supplying the ink from the ink tank to the recording head; a valve for opening or closing the ink-flow passage; a filter disposed in the ink-flow passage between the valve and the recording head and having a mesh smaller than a nozzle diameter of the nozzle; a bubble-injecting device for injecting a bubble into the inside of the recording head; and a suction device for sucking the ink in the recording head from the nozzle.

As described above, in this inkjet printer, the bubble injected by the bubble-injecting device is sucked from the ejection opening of the nozzle in the recording head with the valve in the ink-flow passage closed, so that the bubble expands by a negative pressure. Thereafter, by opening the valve, the expanded bubble goes shrinking to return to the original. At this time, volume change occurs according to the volume of the bubble. According to the volume change and the like, a substantial pressure is applied to the filter, which causes a large differential pressure between the upstream and the downstream of the filter. This differential pressure forcibly moves the ink and bubbles from the upstream toward the downstream of the filter upon releasing the valve. This abrupt moving force by the ink and bubbles breaks the meniscus formed on the filter, and the ink at the filter upstream flows into the downstream passing through the filter. At this time, the bubbles at the filter upstream simultaneously flow into the downstream passing through the filter. A part of the bubbles flowed into the downstream is solved into the ink while flowing in the ink, and the other part is sucked out from the ejection opening of the nozzle. Thus, the bubbles occurred at the upstream of the filter in the ink-flow passage can be removed.

Because of elimination of the bubbles occurred at the upstream of the filter in the ink-flow passage, there can be securely solved the problem of ejection failures in the recording head, such as non-ejection and decrease of droplet volume, allowing formation of improved images.

According to a third aspect of the invention, the inkjet printer includes a recording head having nozzles for ejecting ink, an ink tank for reserving the ink, an ink-flow passage for supplying the ink from the ink tank to the recording head, a valve for opening/closing the ink-flow passage, a filter arranged in the ink-flow passage between the valve and the recording head and having a mesh smaller than a nozzle diameter of the nozzle, a bubble-injecting device for injecting a bubble into the inside of the recording head, a suction device for sucking from the nozzle the ink inside the recording head, and a control unit for controlling injection of the bubble into the inside of the recording head by the bubble-injecting device, opening/closing the valve, and suction by the suction device so that the bubble can be transmitted through the filter from the upstream to the downstream to be sent into the inside of the recording head.

As described above, in this inkjet printer, the bubble injected by the bubble-injecting device is sucked from the ejection opening of the nozzle in the recording head with the valve in the ink-flow passage closed, so that the bubble expands by a negative pressure. Thereafter, by opening the valve, the expanded bubble goes shrinking to return to the original. At this time, volume change occurs according to the volume of the bubble. According to the volume change and the like, a substantial pressure is applied to the filter, which causes a large differential pressure between the upstream and the downstream of the filter. This differential pressure forcibly moves the ink and bubbles from the upstream toward the downstream of the filter upon releasing the valve. This abrupt moving force by the ink and bubbles breaks the meniscus formed on the filter, and the ink at the filter upstream flows into the downstream passing through the filter. At this time, the bubbles at the filter upstream simultaneously flow into the downstream passing through the filter. A part of the bubbles flowed into the downstream is solved into the ink while flowing in the ink, and the other part is sucked out from the ejection opening of the nozzle. Thus, the bubbles occurred at the upstream of the filter in the ink-flow passage can be removed.

Because of elimination of the bubbles occurred at the upstream of the filter in the ink-flow passage, there can be securely solved the problem of ejection failures in the recording head, such as non-ejection and decrease of droplet volume, allowing formation of improved images.

According to a fourth aspect of the invention, a bubble removing method in an inkjet printer is a method for removing bubbles on a filter having a mesh smaller than a nozzle diameter of a nozzle, the filter arranged between an ink tank reserving ink and a recording head having nozzles to eject the ink. The method includes injecting a bubble into the inside of the recording head, closing a valve provided between the ink tank and the filter after injecting the bubble, coupling a vacuum cap to the nozzle that is to eject ink droplets in the recording head and sucking the ink inside the recording head, and opening the valve after sucking the ink.

As described above, in bubble removing method in this inkjet printer, the bubble injected into the inside of the recording head is sucked from the ejection opening of the nozzle in the recording head with the valve in the ink-flow passage closed, so that the bubble expands by a negative pressure. Thereafter, by opening the valve, the expanded bubble goes shrinking to return to the original. At this time, volume change occurs according to the volume of the bubble. According to the volume change and the like, a substantial pressure is applied to the filter, which causes a large differential pressure between the upstream and the downstream of the filter. This differential pressure forcibly moves the ink and bubbles from the upstream toward the downstream of the filter upon releasing the valve. This abrupt moving force by the ink and bubbles breaks the meniscus formed on the filter, and the ink at the filter upstream flows into the downstream passing through the filter. At this time, the bubbles at the filter upstream simultaneously flow into the downstream passing through the filter. A part of the bubbles flowed into the downstream is solved into the ink while flowing in the ink, and the other part is sucked out from the ejection opening of the nozzle. Thus, the bubbles occurred at the upstream of the filter in the ink-flow passage can be removed.

Because of elimination of the bubbles occurred at the upstream of the filter in the ink-flow passage, there can be securely solved the problem of ejection failures in the recording head, such as non-ejection and decrease of droplet volume, allowing formation of improved images.

BRIEF DESCRIPTION OF THE DRAWINGS

The present invention will become more fully understood from the detailed description given hereinafter and the accompanying drawings which are given by way of illustration only, and thus are not intended as a definition of the limits of the scope of the invention, and wherein.

DETAILED DESCRIPTION OF THE INVENTION

Hereinafter, the preferred embodiment of an inkjet printer according to the invention will be described in detail with reference to the accompanying drawings. The invention is not limited to exemplified drawings.

Figure 1:
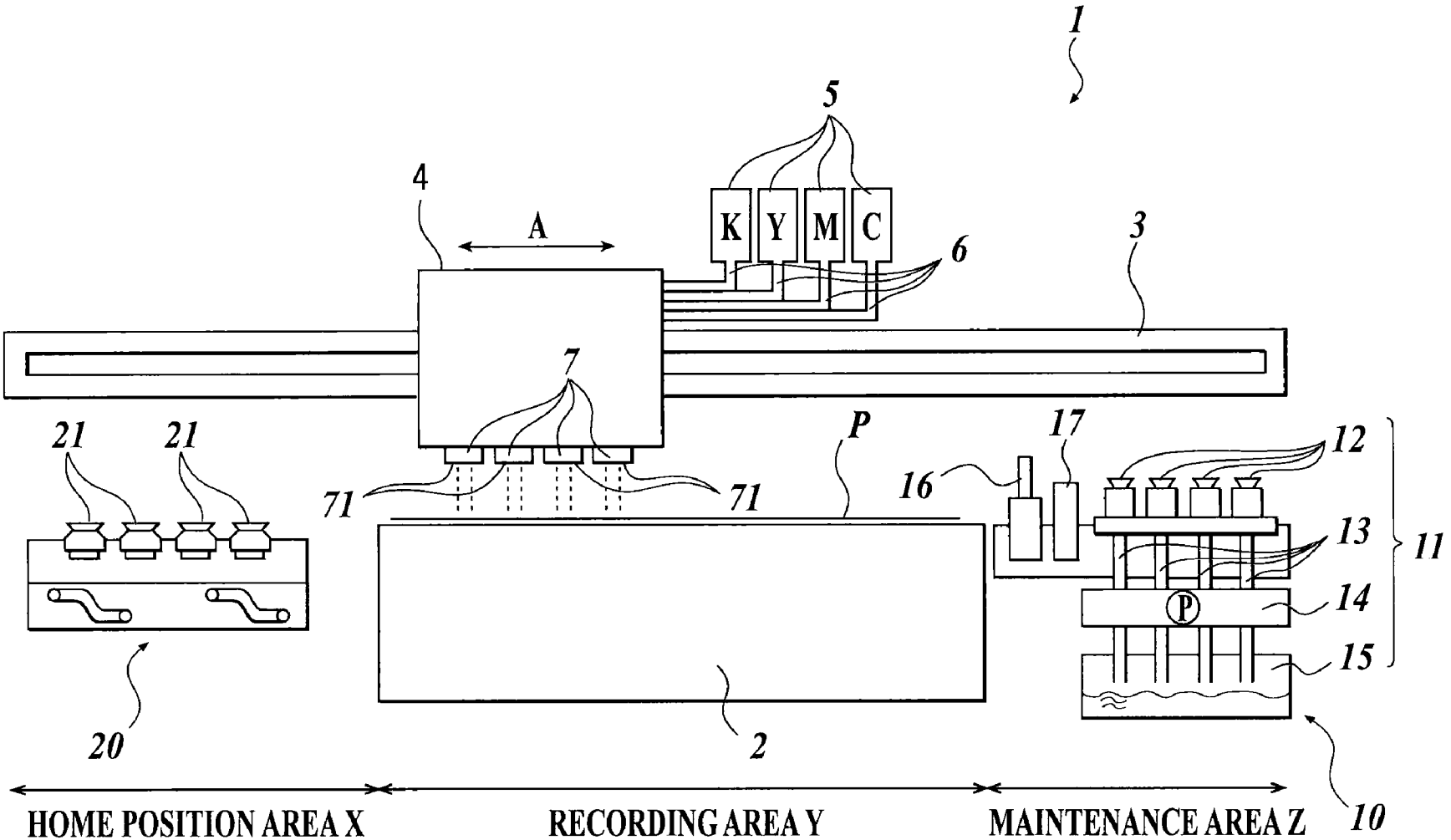
FIG. 1 is a schematic diagram showing the construction of an inkjet printer according to one embodiment of the invention.

First, referring to FIG. 1, the inkjet printer according to one embodiment of the invention will be explained. FIG. 1 is a diagram showing the schematic construction of the entire inkjet printer according to one embodiment of the invention.

An inkjet printer 1 is a serial type inkjet printer that ejects ink onto a recording medium P to record an image on the recording medium P. The inkjet printer 1 has a recording medium transport mechanism 41 (shown in FIG. 4), which transports the recording medium P to a transport direction perpendicular to a main scanning direction A while passing through a recording area Y in FIG. 1, the medium P being supported from the non-recording side on a platen 2 formed in flat plate shape.

Above the platen 2, a guide rail 3 is disposed extending along the main scanning direction A. The guide rail 3 supports a carriage 4 thereon. The carriage 4 has recording heads 7 mounted thereon for ejecting ink on the recording medium P, and reciprocates along the guide rail 3 by a carriage drive mechanism 42 from a home position area X to a maintenance area Z in the main scanning direction A.

Figure 2:
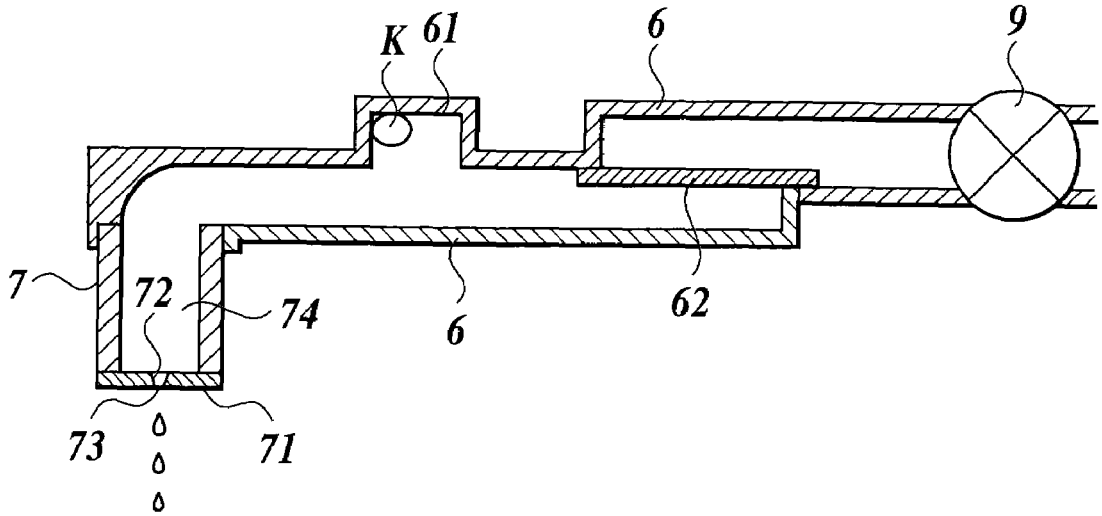
FIG. 2 is a schematic diagram showing an ink-flow passage in the vicinity of a filter in the inkjet printer of the embodiment.

As shown in FIG. 2, on an ejection surface 71 in the recording head 7 opposing the recording medium P, many ejection openings (hereinafter, simply "orifices") 73 of nozzles 72 for ejecting ink are disposed.

In the inkjet printer 1 of the embodiment, the carriage 4 has four recording heads 7 in total for ejecting four colors of ink including black (K), yellow (Y), magenta (M) and cyan (C). In the embodiment, four recording heads 7 are arranged in a line in the main scanning direction A. Meanwhile, the inks used in the inkjet printer are not limited to above colors, but it is also possible to use other colors such as light yellow (LY) and light cyan (LC). In this case, recording heads 7 corresponding to respective colors are mounted on the carriage 4.

Figure 3:
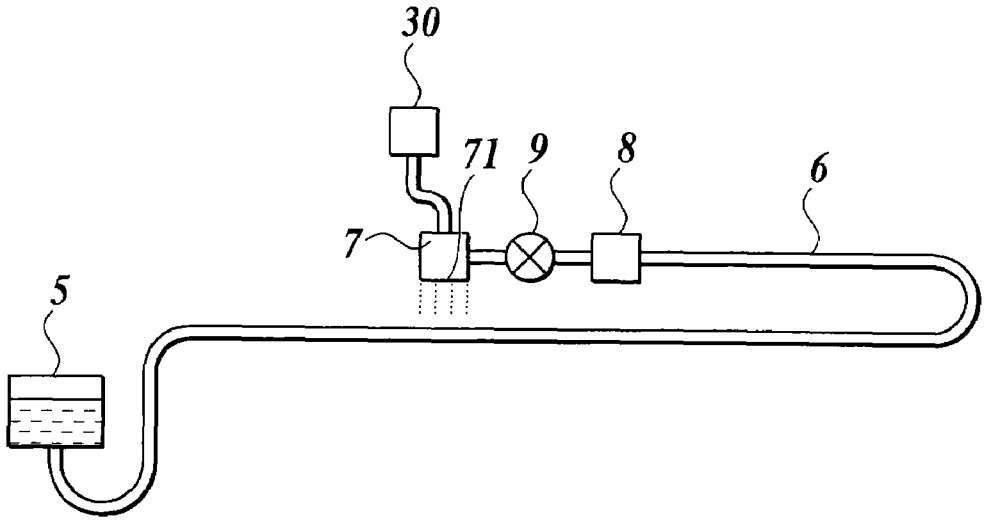
FIG. 3 is a schematic diagram showing the structure from an ink tank to a recording head in the inkjet printer of the embodiment.

Each ink tank 5 reserving each colored ink of black, yellow, magenta and cyan is, as shown in FIG. 3, connected to corresponding head 7 through an ink-flow passage 6 of an ink supply tube or the like. That is, the ink within the ink tank 5 is supplied to each recording head 7 through the ink-flow passage 6. There are provided on the ink-flow passage 6 between the ink tank 5 and the head 7 with a damper 8 as a shock absorber for up-and-down movement of the carriage 4 and with a flow passage control valve 9 for closing and opening the ink-flow passage 6. Further, as shown in FIG. 2, there is provided with a filter 62 for removing contamination in the ink in the ink-flow passage 6 between the flow passage control valve 9 and a pressure chamber 74 that is for ejecting ink in the head 7. There is also provided with a bubble-storing portion for retaining a predetermined volume of bubble K at least in a part of the ink-flow passage 6 between the filter 62 and the pressure chamber 74 of the head 7. For the bubble-storing portion in the embodiment, there is particularly formed a bubble retainer 61 at a part of the ink-flow passage 6 having a usual diameter. Here, the volume of bubble to be retained in the bubble-storing portion is properly determined taking into account various conditions such as kind of ink and shape of the ink-flow passage.

The printer in the embodiment further includes a sensor 43 for detecting the bubble K residing in the bubble retainer 61 as a bubble-storing portion or for detecting the bubble volume, and a bubble-injecting device 44 for sending the bubble K into the bubble retainer 61. If it is determined, based on the detected result of the bubble K or the bubble volume by the sensor 43, that the bubble K in the bubble retainer 61 becomes so small as not to produce a differential pressure necessary for sucking bubbles K2 (shown in FIG. 6) retained at the upstream side of the filter 62, the bubble-injecting device 44 sends a necessary volume of bubble K into the bubble retainer 61. As to the bubble-injecting device, it may be a mechanical device or a mechanism for sending bubbles into the bubble retainer (bubble-storing portion) by a pump or the like, or may be a relatively simple structure in which the bubble retainer is communicated with the outside by opening/closing a valve to inject bubbles therein.

Figure 6:
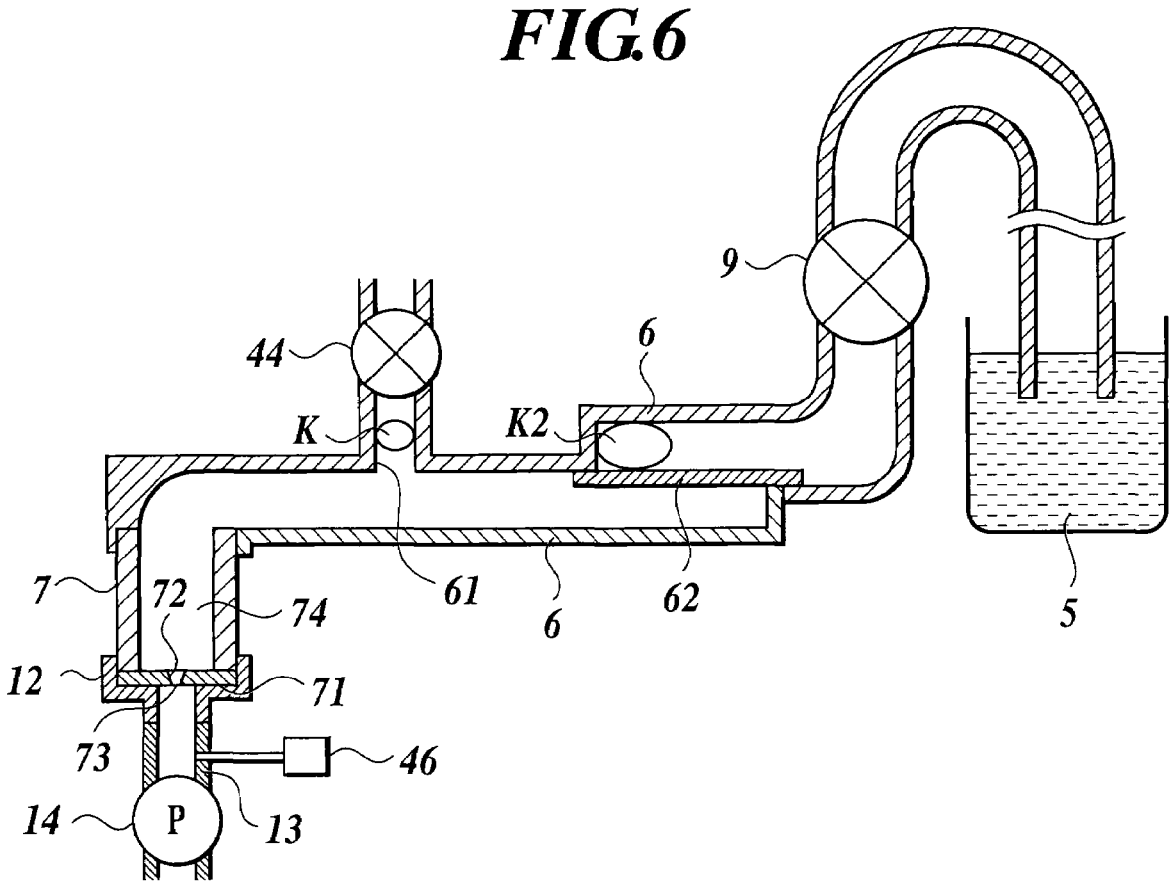
FIG. 6 is a schematic diagram showing a structure of a test for proving effects of the invention.

The bubble-injecting device 44 in the embodiment is so structured, as shown in FIG. 6, as to inject the bubble K into the ink-flow passage 6 between the filter 62 and the recording head 7 to send the bubble into the bubble retainer 61, but the device is not limited to this structure.

For instance, the bubble-injecting device may be so structured as to inject bubbles from the nozzle orifice of a head to send bubbles into the bubble-storing portion. Specifically, the bubble-injecting device may be implemented as in the following structure.

In this case, a suction device 11, to be described later, is enabled to operate reverse to suction operation, that is, to operate so that fluid flows backward from a vacuum cap 12 to the recording head 7. The vacuum cap 12 covers the ejection surface 71 of the head 7, and then the suction device 11 applies pressure. This breaks a meniscus at the orifice 73 to inject air (bubble K) into the orifice 73 of the head 7 so as to send the bubble K through the head 7 into the bubble retainer 61 as the bubble-storing portion. As another example, the suction device 11 or other device may give shocks to the recording head 7 so as to break a meniscus at the orifice 73 to inject the bubble K from the orifice 73 into the head 7 to thereby send the bubble K through the head 7 into the bubble retainer 61.

Alternatively, a bubble-injecting device may be structured such that bubbles are injected so as to cover the entire filter at the upstream side of the filter and enable the bubbles to transmit through the filter to the downstream side of the filter to send bubbles into a bubble-storing portion. Specifically, the bubble-injecting device may be implemented as in the following structure.

In this case, there is provided with a bubble-injecting device composed of a compressor, an air valve or the like for injecting bubbles into the upstream of the filter 62, that is, between the ink tank 5 and the filter 62. The bubble-injecting device is structured such that the bubbles K are injected so as to cover not a part of the upstream side of the filter 62 but the entire filter. With this, the bubbles K are injected to cover the entire filter 62, the suction cap 12 covers the ejection surface 71, and sucking operation enables the bubbles K to pass through the filter 62 to thereby send and retain the bubbles K in the bubble retainer 61.

Compared with the case that the bubble K2 (see FIG. 6), which causes ejection failures in the head 7, is retained at a part of the upstream of the filter 62, injection of bubbles K so as to cover the entire filter applies pressure on the filter 62 uniformly, which permits easier break of meniscuses at the filter 62 thereby enabling the bubble K to pass through the filter 62 with less pressure. Above example uses this characteristic, so that smaller pressure enables the bubbles K to pass through the filter 62 to send the bubbles into the bubble-storing portion.

As other example of injecting bubbles into the filter upstream, it is also possible to send bubbles K from the ink tank 5 together with ink.

Figure 5:
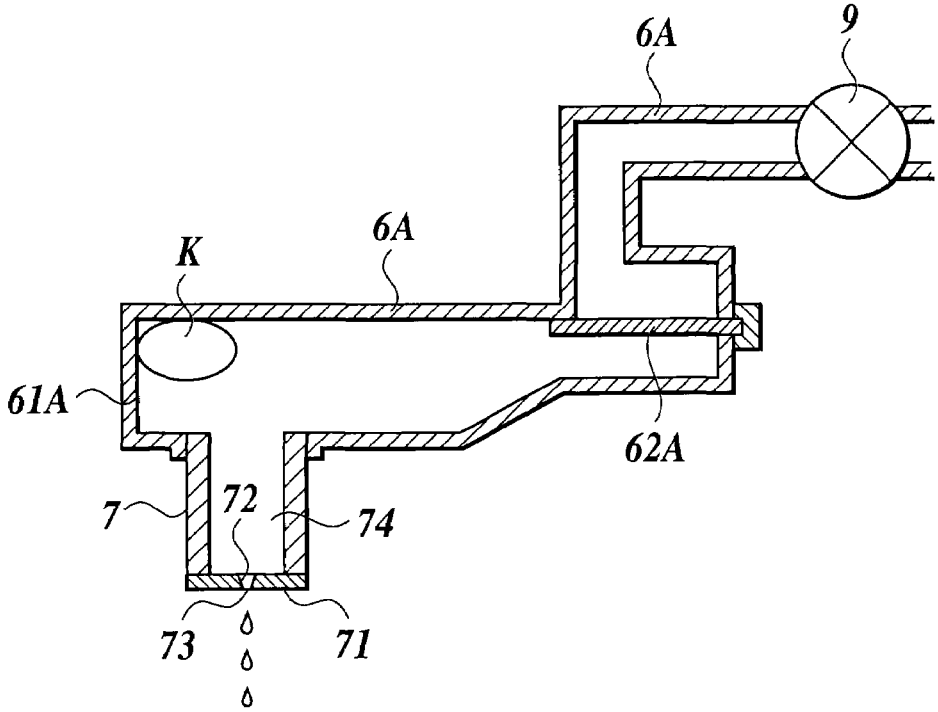
FIG. 5 is a schematic diagram showing an ink-flow passage in the vicinity of a filter in the inkjet printer of another embodiment.

As for the bubble-storing portion, other than the particularly formed bubble retainer 61 as shown in FIG. 2, there may be provided, as shown in FIG. 5, with a moderately expanded portion 61A that has a little larger diameter in an ink-flow passage 6A at the downstream of the filter 62A, or provided with other type of bubble-storing portion. In FIG. 5, those elements that are the same elements described in FIG. 2 are designated by the same reference numerals and the description thereof is omitted.

As for the ink tank to reserve ink, there is sometimes provided with a main tank with a large capacity and a sub tank with a small capacity. In this case, the ink is supplied from the main tank to the sub tank to temporarily reserve the ink, and then supplied from the sub tank to the recording head. In this case, there is arranged a filter at least between the sub tank and the recording head.

In a movable area of the carriage 4 and at one end outside the recording area Y where the platen 2 is provided, there is provided with a maintenance area Z, where a maintenance unit 10 is arranged for applying head maintenance to the recording heads 7. The maintenance unit 10 includes suction device 11 for sucking ink from the orifices 73 of nozzles 72, cleaning blade 16, ink receiver 17, etc.

The suction device 11 includes four vacuum caps 12 corresponding to the number of heads 7, each cap being to cover the ejection surface 71 of the head 7. Provided at the bottom of each vacuum cap 12 is an ink-passing pipe 13 to communicate with the inside of the cap 12. In the middle of the passing pipe 13, a vacuum pump 14 is provided, and at the lower end of the pipe 13, a waste ink tank 15 is provided for receiving sucked ink.

In the vicinity of one end of the vacuum cap 12, there is provided with an ink receiver 17 for receiving ejected ink when the ink is ejected from the orifices 73 of the recording heads 7 as dummy ejections, and also with a blade 16 neighboring the ink receiver 17 for wiping off the ink adhered to the ejection surfaces 71.

The vacuum pump 14 includes a cylinder pump or tube pump, and generates a suction force for sucking ink inside the heads 7 from the orifices 73 together with contamination and bubbles by operating with the vacuum caps 12 covering the ejection surfaces 71.

Instead of the blade 16 in the maintenance unit 10, an ink-absorbing device may be provided for absorbing the ink adhered to the suction surfaces 71.

The ink-absorbing device, for example, includes a sheet of ink absorbent, roll shafts arranged at both ends of the ink absorbent for rolling the ink absorbent, a heater arranged under the ink absorbent between the two roll shafts for heating the ink absorbent, and a roll shaft driving mechanism.

At another end in the movable area of the carriage 4, there is designated a home-position area X opposing to the maintenance area Z with the platen 2 arranged between them. There is provided in the home-position area X with a humidity-retaining unit 20 for retaining humidity around the heads 7. The humidity-retaining unit 20 has four humidity retaining caps 21 to cover the ejection surfaces 71 for retaining humidity of the ink in the heads 7 when the heads 7 are in a standby state. The four humidity-retaining caps 21 are arranged corresponding to the arrangement of the heads 7 so as to cover the respective four ejection surfaces 71.

Next, a control structure of the embodiment will be explained with reference to FIG. 4.

Figure 4:
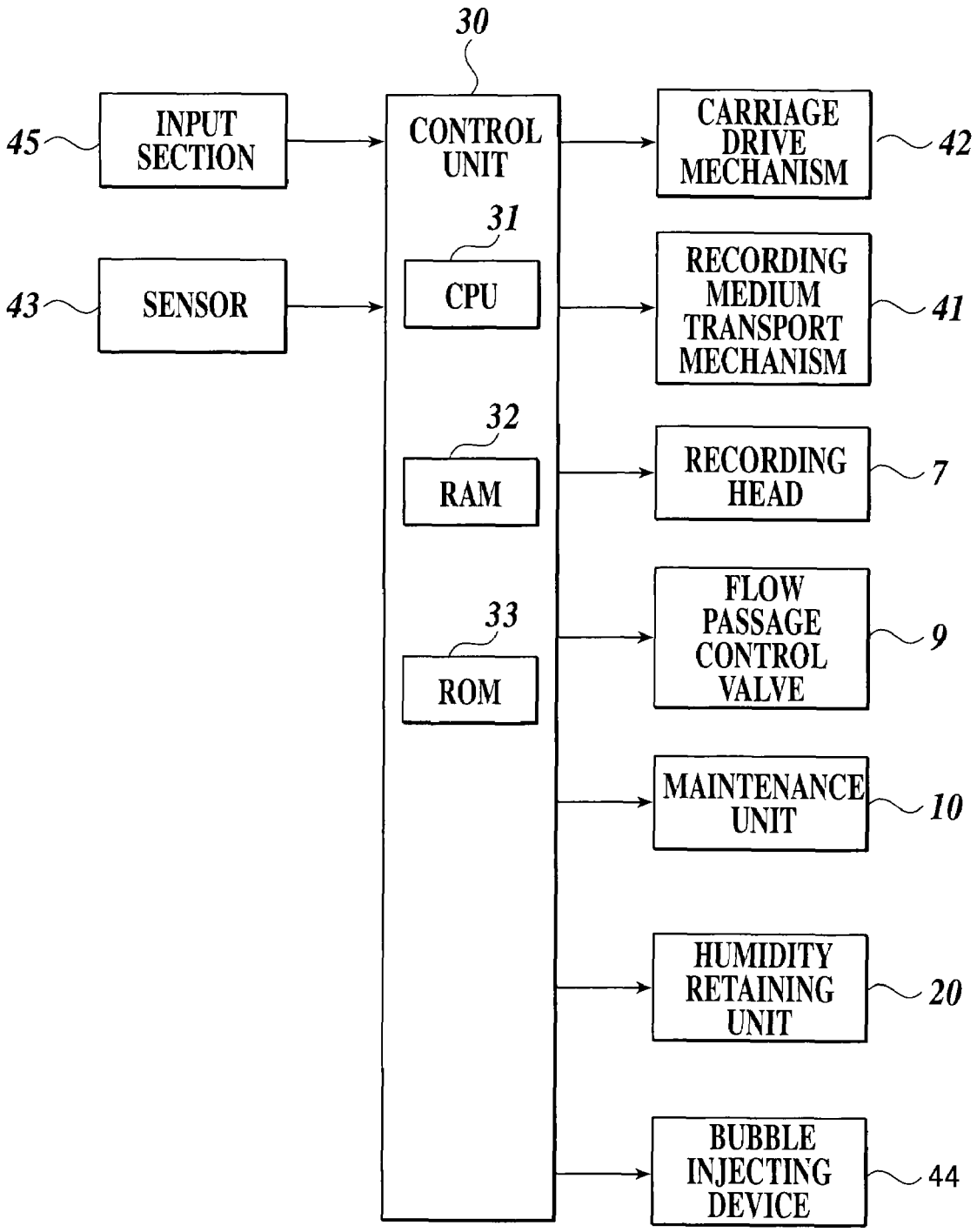
FIG. 4 is a control block diagram showing a main control structure in the inkjet printer of the embodiment.

In the embodiment, the inkjet printer 1 has, as shown in FIG. 4, a control unit (hereinafter, simply "controller") 30 for controlling carriage drive mechanism 42, recording medium transport mechanism 41, recording heads 7, maintenance unit 10, humidity-retaining unit 20, flow passage control valve 9, sensor 43, bubble-injecting device 44, etc. The controller 30 includes a CPU 31, a RAM 32 and a ROM 33, and connected through an interface (not shown) to carriage drive mechanism 42, recording medium transport mechanism 41, recording heads 7, maintenance unit 10, humidity-retaining unit 20, flow passage control valve 9, sensor 43, bubble-injecting device 44, input section 45, etc.

The controller 30 controls the carriage drive mechanism 42 and the recording medium transport mechanism 41 such that the carriage 4 reciprocates in the main scanning direction A, and the recording medium P is repeatedly transported and stopped in synchronism with the carriage 4 movement to be intermittently transported to a transporting direction.

The controller 30 is connected to the input section 45 consisting of a host computer or a scanner to input image information or a keyboard to input image record conditions, and the recording heads 7. The controller 30 operates the heads 7 based on predetermined signals input from the input section 45 to eject ink onto the recording medium P to record a predetermined image.

The controller 30 operates the maintenance unit 10 and the flow passage control valve 9 to perform head maintenance in case of meeting a predetermined maintenance start condition, every time a certain time has elapsed from the time of turning-on the power, or by manual operation.

Further, the controller 30 controls the humidity retaining unit 20 to perform humidity retaining operation by the humidity retaining caps 21 when the printer is not in an image forming state and not in the head maintenance state, namely, in a standby state.

Further, the controller 30 monitors by the sensor 43 the existence or the volume of the bubble K in the bubble-storing portion like the bubble retainer 61, and when the sensor 43 detects that the bubble K is a little volume or not found, the controller controls operation of the bubble-injecting device 44 to send a predetermined volume of bubble into the bubble-storing portion.

Next, operations of the inkjet printer 1 constructed as described above will be explained.

Initially, the printer in the embodiment is not in an image recording state and not in the head maintenance state but in a standby state in which the carriage 4 stands by above the humidity retaining unit 20 and the humidity retaining caps 21 cover the orifices 73 of the nozzles 72 to protect the orifices 73.

Next, operations at the time of image recording will be explained.

First, a user sets a recording medium P on the inkjet printer 1, and turns on power of the printer 1 to supply power to every part of the printer 1. Then, when image information is sent from the input section 45 and setting information for various image recording conditions are sent to the controller 30, the controller 30 initiates the image recording, and the carriage 4 moves over the platen 2. At this time, the humidity retaining unit 20 moves downward and the humidity retaining caps 21 are released from the recording heads 7.

When the carriage 4 reaches a predetermined position, the recording medium transport mechanism 41 transports the medium P in the transporting direction and the carriage 4 reciprocates on the platen 2 in the main scanning direction A. Here, the recording medium transport mechanism 41 enables repetition of alternate transport and stop to intermittently transport the medium P.

During the stop in the intermittent transportation, the carriage 4 moves forward and backward, or reciprocates on the platen 2 in the main scanning direction A. According as the carriage 4 moves, the plurality of recording heads 7 also move together with the carriage 4, the heads 7 eject ink from the orifices 73 toward the medium P during the movement, and flying droplets of ink land on the staying medium P. With repetition of this process, the predetermined image can be recorded on the medium P.

Operations at the time of head maintenance will now be explained.

At the time of head maintenance of the recording heads 7, the carriage 4 first moves along the guide rail 3 over the suction device 11 in the maintenance unit 10, and the vacuum caps 12 cover the orifices 73 of the heads 7. Then, the flow passage valve 9 is closed, the vacuum pump 14 operates, thus suction starts. As the negative pressure in the ink-flow passage 6 becomes larger, the bubbles at the upstream side of the filter 62 and the bubble K at the downstream expand. Here, the bubble K at the downstream of the filter is so set that the expansion os larger than that of the bubbles at the upstream. Thereafter, the vacuum pump 14 stops and the flow passage control valve 9 is opened with the vacuum caps 12 closely coupled, which causes the bubbles at the upstream and the bubble at the downstream of the filter 62 to go shrinking to return to the original state. At this time, since volume change of the bubble at the downstream is larger than that of the upstream, a differential pressure to break the meniscus is generated so as for the ink to flow toward the orifice 73, so that the bubbles flow together with the ink from the upstream of the filter 62 into the downstream. A part of the bubbles flowed into the downstream is dissolved into the ink while flowing in the ink, and another part of the bubbles is united with the bubble retained in the bubble retainer 61, and the other part of the bubbles is sucked out from the orifice 73. Such suction operation enables the bubbles produced in the ink-flow passage 6 at the upstream of the filter 62 to be removed. Here, if the bubbles at the filter upstream are not removed by one time of suction operation, then the same suction operations will be repeated several times.

Thereafter, the vacuum caps 12 are separated apart, and the carriage 4 moves to a position of the blade 16 for maintenance operation such as wiping of the ejection surfaces 71 by the blade 16.

Then, the blade 16 is separated apart, and the carriage 4 moves to a position of the ink receiver 17 to perform dummy ejection, and the head maintenance operation ends.

Figure 9:
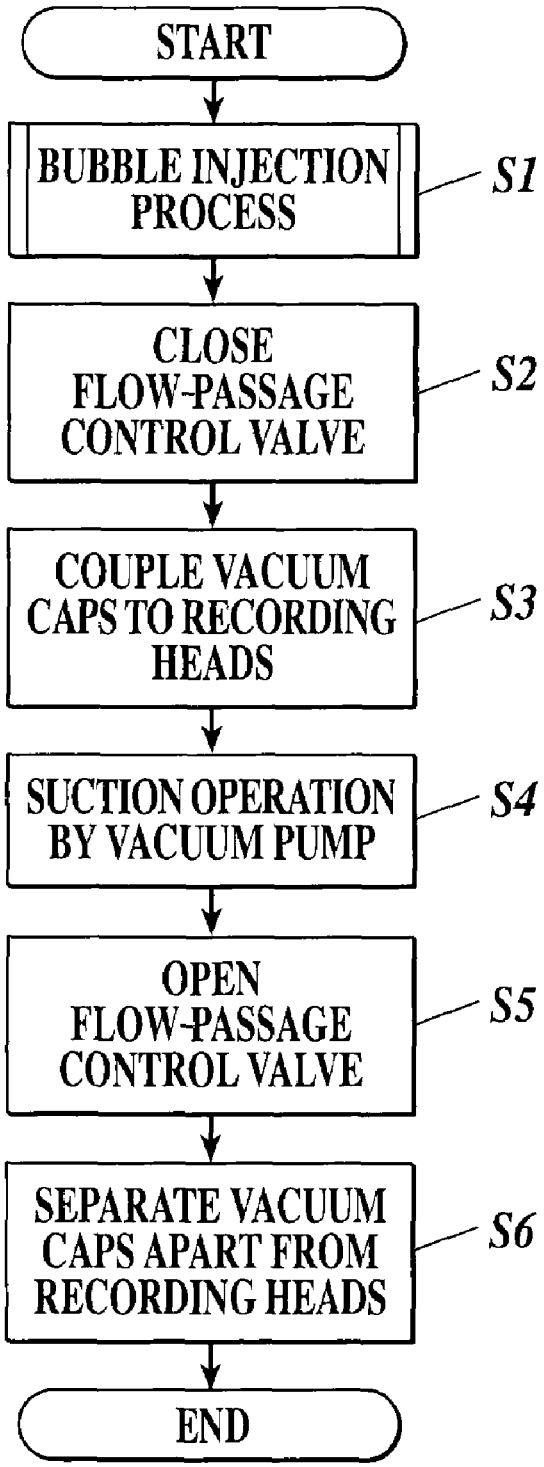
FIG. 9 is a flowchart explaining suction processing of a bubble removing method in the inkjet printer according to one embodiment of the invention.

A detailed description will be given of ink suction processing for sucking ink from the recording heads 7 with reference to FIG. 9.

When applying the ink suction processing, the controller 30 first sends a bubble into the bubble retainer 61 by a bubble injecting process (step S1) to be described later. Here, if the bubble is retained naturally in the bubble retainer 61, the following suction processing may be performed without particular application of this bubble injecting process.

Next, with the flow passage control valve 9 closed (step S2), the controller 30 enables the vacuum caps 12 to couple to the recording heads 7 to cover the orifices 73 (step S3). When the vacuum caps 12 couple to the recording heads 7, the controller 30 enables the vacuum pump 14 to operate to start suction operation (step S4). With this, as the negative pressure in the ink-flow passage 6 becomes larger, the bubbles at the upstream side of the filter 62 and the bubble K at the downstream expand. Here, the bubble K at the downstream of the filter is so set that the expansion is larger than that of the bubbles at the upstream.

Thereafter, the controller 30 enables the vacuum pump 14 to stop and the flow passage control valve 9 to be opened with the vacuum caps 12 closely coupled (step S5). This causes the bubbles at the upstream and the bubble at the downstream of the filter 62 to go shrinking to return to the original state. At this time, since volume change of the bubble at the downstream is larger than that of the upstream, a differential pressure to break the meniscus is generated for the ink to flow toward the orifice 73, so that the bubbles flows together with the ink from the upstream of the filter 62 into the downstream.

A part of the bubbles flowed into the downstream is dissolved into the ink while flowing in the ink, and another part of the bubbles is united with the bubble retained in the bubble retainer 61, and the other part of the bubbles is sucked out from the orifice 73. After such suction operation has removed the bubbles occurred in the ink-flow passage 6 at the upstream of the filter 62, the controller 30 enables the vacuum caps 12 to separate apart from the heads 7 (step S6), and the ink suction processing ends.

Next, a detailed description will be given of the bubble injecting process to send a bubble into the bubble retainer 61 (bubble-storing portion) with reference to FIGS. 10 and 11. As for the bubble injecting process, various methods may be applicable, but in the embodiment, two methods will be explained, one is a method of using the bubble-injecting device 44 (see FIG. 10), and the other is a method of sending the bubble into the bubble retainer 61 by the suction device 11 without using the bubble-injecting device 44 (see FIG. 11).

Figure 10:
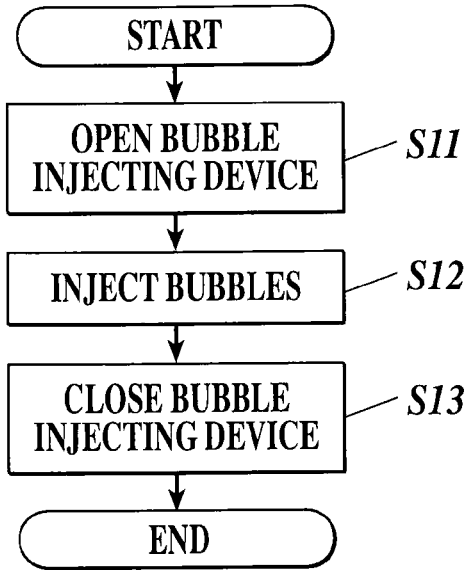
FIG. 10 is a flowchart explaining a bubble injecting process of the bubble removing method in the inkjet printer according to one embodiment of the invention.

In the case that the bubble is sent into the bubble retainer 61 using the bubble-injecting device 44, as shown in FIG. 10, the controller 30 first makes the bubble-injecting device 44 to be opened (step S11). This causes the bubble K to be injected into the downstream of the filter 62 (step S12). When the bubble is injected, the controller 30 makes the bubble-injecting device 44 to be closed (step S13). And the bubble injecting operation ends.

Here, the bubble-injecting device 44 may be so structured as to inject the bubble K into the ink-flow passage 6 between the filter 62 and the recording head 7 to send the bubble into the bubble retainer 61, or the bubble-injecting device 44 may be structured such that bubbles are injected so as to cover the entire filter at the upstream and enable the bubbles to transmit through the filter to the downstream to send the bubble into the bubble retainer 61.

Figure 11:
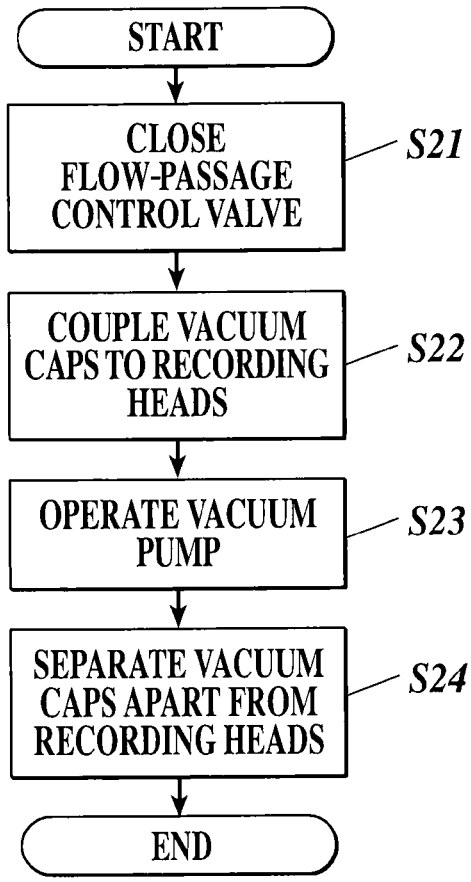
FIG. 11 is a flowchart explaining a modification of the bubble injecting process shown in FIG. 10.

Next, in the case that the bubble is sent into the bubble retainer 61 by the suction device 11 without using the bubble-injecting device 44, as shown in FIG. 11, the controller 30 first makes the flow passage control valve 9 to be closed (step S21), and the vacuum caps 12 couple to the recording heads 7 so as to cover the orifices 73 (step S22).

When the vacuum caps 12 couple to the heads 7, the controller 30 enables the vacuum pump 14 to operate reverse to the suction operation, that is, to operate so that the ink flows backward from the vacuum caps 12 to the recording heads 7 (step S 23). This enables the suction device 11 to apply pressure to the inside of the heads 7, which breaks each meniscus at the orifice 73 to inject air (bubble K) into the orifice 73 of the head 7 so as to send the bubble K through the head 7 into the bubble retainer 61.

After injection of the bubble, the controller 30 makes the vacuum caps 12 to be separated apart from the heads 7 (step S24), and the bubble injecting operation ends.

Next, a description will be given of experiments for proving effects of the invention.

By using a part of the inkjet printer 1 of the embodiment, for different bubble volumes retained in the bubble-storing portion, the suction device 11 in the maintenance unit 10 performs sucking operation, and there was investigated the relationship between the differential pressure in the front and rear of the filter 62 and the volume of bubbles passing through the filter 62. A detailed description will be given below.

Initially, as shown in FIG. 6, sufficient volume of bubbles K2 are injected at the upstream of the filter 62 (ink tank 5 side) arranged in the ink-flow passage 6 for removing contamination in ink. Further, controlling the bubble-injecting device 44, a predetermined bubble K is retained in the bubble retainer 61 as the bubble-storing portion. In this test, as the injecting device 44, there is employed an air valve communicating with the outside for directly injecting bubbles into the bubble retainer 61 provided in the ink-flow passage 6 between the filter 62 and the recording head 7. With this, the bubble volume is controlled by opening/closing the air valve.

Figure 7:
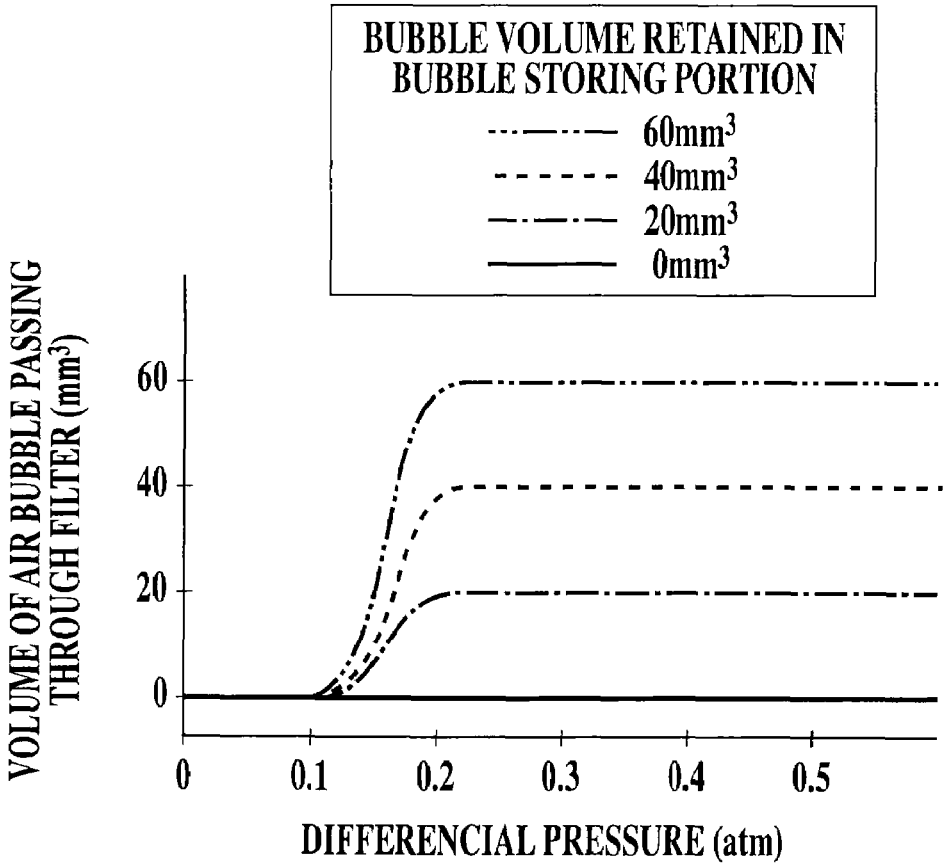
FIG. 7 is a graph showing a test result of the test for proving effects of the invention.
Figure 8:
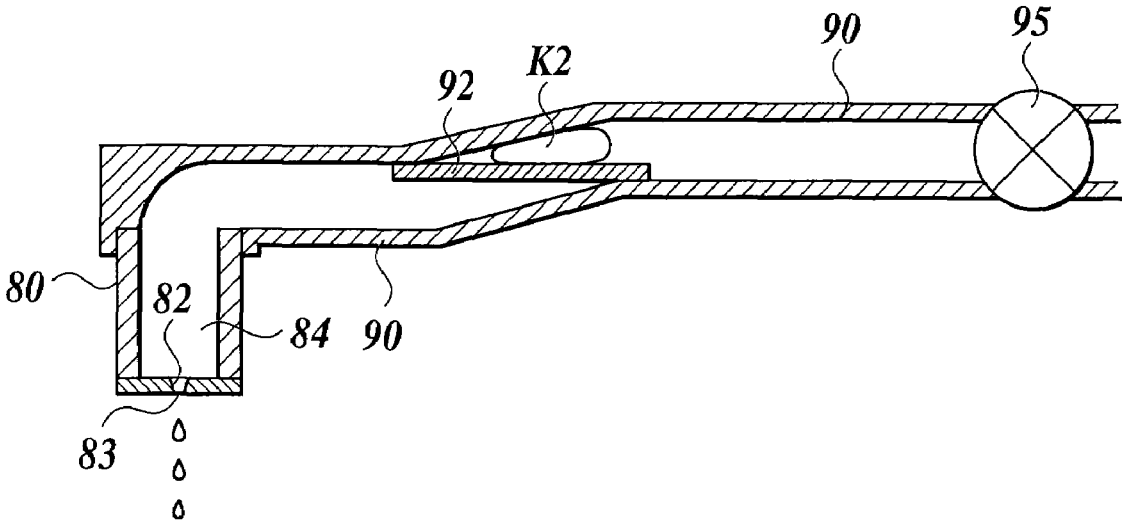
FIG. 8 is a schematic diagram showing an ink-flow passage in the vicinity of a filter in a conventional inkjet printer.

The orifices 73 are covered with the vacuum caps 12. Then, with the flow passage control valve 9 closed, the vacuum pump 14 is operated to start suctioning. At this time, the differential pressure in the front and rear of the filter 62 is measured by a pressure gauge 46 that has been installed in advance. When the differential pressure reaches a predetermined value, the vacuum pump 14 is stopped, and then the flow passage control valve 9 is opened with the vacuum caps 12 tightly closed. Here, when the differential pressure is enough to break a meniscus on the filter 62, the bubbles K2 are forcibly flown through the filter 62 to the downstream together with the ink as the meniscuses break at the filter 62. At this time, there is measured the volume of the bubbles K2 that have passed through the filter 62 to the downstream with the ink. This process was repeated by changing the differential pressures, and there was investigated the relationship between the differential pressure and the volume of the bubbles K2 passed through the filter 62. Also, when the volume of the bubble K retained in the bubble retainer 61 is set to 0, 20, 40 and 60 $mm^3$, there was investigated the relationship between the differential pressure and the volume of the bubbles K2 passed through the filter 62, and the result is presented in a graph of FIG. 7. Here, with the filter 62 and the ink used in the test, the value of breaking the meniscus was about 0.1 atm. With the use of usual filter and ink, the meniscus breaking value is mostly 0.3 atm or less.

As a result, when predetermined differential pressures were applied for the cases that the volumes of the bubble K retained in the bubble retainer 61 were set to 20, 40 and 60 $mm^3$, predetermined volumes of bubbles K2 passed through the filter 62. To the contrary, for the case that the volume of the bubble K was 0 $mm^3$, the bubbles K2 never passed through the filter 62 with application of any differential pressures. Resultantly, it was found that the existence of bubble K in the bubble retainer 61 allows the bubbles K2 to pass through the filter 62.

It was found further that, if the differential pressure exceeds a meniscus-break value (here, 0.1 atm), the bubbles K2 pass through the filter 62. Furthermore, at the differential pressure more than the predetermined one (here, 0.3 atm or more), the volume of bubbles K2 passing through the filter 62 remains unchanged, and the upper limit volume of bubbles K2 passing through is almost the same as of the bubble K retained in the bubble retainer 61.

As described above, the inkjet printer according to the embodiment is provided with a bubble-storing portion for retaining a predetermined volume of bubble in an area between a filter and a recording head, that is, in a part of an ink-flow passage at the downstream of the filter, and therefore, when the bubble, which is gas retained in the bubble-storing portion, is sucked from the orifice of a nozzle in the recording head with the valve closed, the bubble expands by a negative pressure. Thereafter, by opening the valve, the expanded bubble goes shrinking to return to the original. At this time, a volume change occurs according to the volume of the retained bubble. On the other hand, when the bubbles, which are retained in the upstream of the filter, are sucked from the orifice of the nozzle with the valve closed, the bubbles also expand by a negative pressure. By opening the valve thereafter, the expanded bubbles go shrinking to return to the original. At this time, a volume change occurs according to the volume of the retained bubbles. According to a difference between these volume changes, a differential pressure is generated from the upstream toward the downstream of the filter. When this differential pressure is high enough to break the meniscus formed on the filter, the ink at the filter upstream flows into the downstream passing through the filter. At this time, the bubbles at the filter upstream simultaneously flow into the downstream passing through the filter. The bubbles flowing into the downstream are partly solved into the ink while flowing in the ink, and the other parts are sucked out from the orifice of the nozzle. Thus, the bubbles occurred at the upstream of the filter in the ink-flow passage can be removed.

This elimination of bubbles can resultantly reduce hardening of ink on a nozzle surface and maintain a normal image recording state.

Here, the volume change of the bubble retained at the downstream of the filter has to be large enough relative to the volume change of the bubbles retained at the upstream of the filter so that the generated differential pressure can break the meniscus.

In the embodiment, a bubble-injecting device is provided for sending a bubble into the bubble-storing portion by injecting the bubble into the ink-flow passage between the filter and the recording head, namely, the downstream of the filter. Therefore, even if the bubble retained in the bubble-storing portion is ejected out from the orifice of the nozzle, repeated injection of the bubble can easily resume the state in which the bubbles retained at the filter upstream in the ink-flow passage can be removed.

As a result, this injection of the bubble can more securely solves the problem of ejection failures in the recording head, such as non-ejection and decrease of droplet volume, allowing formation of more excellent images.

If the bubble-injecting device has such a structure that the bubble is injected from the orifice of the nozzle to be sent into the bubble-storing portion, or has such a structure that bubbles are injected into the filter upstream so as to cover the entire filter and transmitted through the filter to be sent into the bubble-storing portion, the same action and effect can be attained.

The inkjet printer according to the present invention is not limited to these embodiments described above, and various modifications and design changes may be made without departing from the spirit and scope of the invention.

For instance, the recording head may include, for example, a heater without limited use of a piezoelectric element.

The inkjet printer of the embodiment has four recording heads, but the number is not critical and proper number of recording heads may be used.

The inkjet printer of the embodiment is a serial-type inkjet printer, in which, while recording heads mounted on a carriage reciprocate in the main scanning direction and a recording medium is transported in the transporting direction, ink droplets are ejected from the heads to form an image, but the invention is also applicable to a line-type inkjet printer in which a recording head fixed to a printer main body ejects droplets of ink and a recording medium is transported so as to form an image thereon.

The entire disclosure of Japanese Patent Application No. Tokugan 2005-169731 which was filed on Jun. 9, 2005, including specification, claims, drawings and summary are incorporated herein by reference in its entirety.

What is claimed is:

1. An inkjet printer comprising:

a recording head having nozzles for ejecting ink;

an ink tank for reserving the ink;

an ink-flow passage for supplying the ink from the ink tank to the recording head;

a valve for opening or closing the ink-flow passage;

a filter disposed in the ink-flow passage between the valve and the recording head;

a vacuum cap to be coupled to the recording head so as to cover an ejection opening of the nozzle when sucking an ink from the ejection opening;

a vacuum pump for sucking the ink from the ejection opening through the vacuum cap; and a bubble-storing portion provided at least at a part of the ink-flow passage between the filter and the recording head, for storing a predetermined volume of bubble; and a bubble-injecting device for sending a bubble into the bubble-storing portion;

wherein the buttle-injecting device has a structure to inject the bubble into the ejection opening of the nozzle in the recording head, and send the bubble into the bubble-storing portion.

2. An inkjet printer comprising:

a recording head having nozzles for ejecting ink;

an ink tank for reserving the ink;

an ink-flow passage for supplying the ink from the ink tank to the recording head;

a valve for opening or closing the inkflow passage;

a filter disposed in the ink-flow passage between the valve and the recording head;

a vacuum cap to be coupled to the recording head so as to cover an ejection opening of the nozzle when sucking an ink from the ejection opening;

a vacuum pump for sucking the ink from the ejection opening through the vacuum cap;

a bubble-storing portion provided at least a part of the ink-flow passage between the filter and the recording head, for storing a predetermined volume of bubble; and a bubble-injecting device for sending a bubble into the bubble-storing portion;

wherein the bubble-injecting device has a structure to inject the bubble into the ink flow passage, upstream of the filter, so as to cover the entire filter and transmit the bubble through the filter, and downstream thereof, and send the bubble into the bubble-storing portion.

3. An inkjet printer comprising:

a recording head having nozzles for ejecting ink;

an ink tank for reserving the ink;

an ink-flow passage for supplying the ink from the ink tank to the recording head;

a valve for opening or closing the ink-flow passage;

a filter disposed in the ink-flow passage between the valve and the recording head and having a mesh smaller than a nozzle diameter of the nozzle;

a bubble-injecting device for injecting a bubble into inside of the recording head;

a suction device for sucking the ink in the recording head from the nozzle; and a bubble-storing portion provided at least a part of the ink-flow passage between the filter and the recording head, for storing a predetermined volume of bubble, wherein the bubble-injecting device has a structure to inject the bubble into the ejection opening of the nozzle in the recording head and send the bubble into the bubble-storing portion.

4. An inkjet printer comprising:

a recording head having nozzles for ejecting ink;

an ink tank for reserving the ink;

an ink-flow passage for supplying the ink from the ink tank to the recording head;

a valve for opening or closing the ink-flow passage;

a filter disposed in the ink-flow passage between the valve and the recording head and having a mesh smaller than a nozzle diameter of the nozzle;

a bubble-injecting device for injecting a bubble into inside of the recording head;

a suction device for sucking the ink in the recording head from the nozzle; and a bubble-storing portion provided at least at a part of the ink-flow passage between the filter and the recording head, for storing a predetermined volume of bubble, wherein the bubble-injecting device has a structure to inject the bubble into the ink-flow passage, upstream of the filter, so as to cover the entire filter, to transmit the bubble through the filter, and downstream thereof, and send the bubble into the bubble-storing portion.

5. An inkjet printer comprisng:

a recording head having nozzles for ejecting ink;

an ink tank for reserving the ink;

an ink-flow passage for supplying the ink from the ink tank to the recording head;

a valve for opening or closing the ink-flow passage;

a filter disposed in the ink-flow passage between the valve and the recording head and having a mesh smaller than a nozzle diameter of the nozzle;

a bubble-injecting device for injecting a bubble into inside of the recording head;

a suction device for sucking the ink in the recording head from the nozzle;

a control unit for controlling injection of the bubble into the inside of the recording head by the bubble-injecting device, opening and closing the valve, and suction by the suction device, to transmit the bubble through the filter from an upstream to a downstream and to send the bubble to the inside of the recording head; and a bubble-storing portion provided at least at a part of the ink-flow passage between the filter and the recording head, for storing a predetermined volume of bubble, wherein the bubble-injecting device has a structure to inject the bubble into the ejection opening of the nozzle in the recording head, and send the bubble into the bubble-storing portion.

6. An inkjet printer comprising:

a recording head having nozzles for ejecting ink;

an ink tank for reserving the ink;

an ink-flow passage for supplying the ink from the ink tank to the recording head;

a valve for opening or closing the ink-flow passage;

a filter disposed in the ink-flow passage between the valve and the recording head and having a mesh smaller than a nozzle diameter of the nozzle;

a bubble-injecting device for injecting a bubble into inside of the recording head;

a suction device for sucking the ink in the recording head from the nozzle;

a control unit for controlling injection of the bubble into the inside of the recording head by the bubble-injecting device, opening and closing the valve, and suction by the suction device, to transmit the bubble through the filter from an upstream to a downstream and to send the bubble to the inside of the recording head; and a bubble-storing portion provided at least at a part of the ink-flow passage between the filter and the recording head, for storing a predetermined volume of bubble, wherein the bubble-injecting device has a structure to inject the bubble into the ink-flow passage, upstream of the filter so as to cover the entire filter and transmit the bubble through the filter and downstream thereof, and send the bubble into the bubble-storing portion.

7. A bubble removing method in an inkjet printer for removing a bubble on a filter having a mesh smaller than a nozzle diameter of a nozzle, the filter disposed between an ink tank to reserve ink and a recording head having nozzles to eject the ink, the method comprising:

injecting a bubble into the inside of the recording head;

closing a valve provided between the ink tank and the filter after injecting the bubble;

coupling a vacuum cap to a nozzle to eject ink droplets in the recording head and sucking the ink inside the recording head; and opening the valve after sucking the ink.

* * * * *